US005532098A

United States Patent [19]

Ong

[11] Patent Number: 5,532,098

[45] Date of Patent: Jul. 2, 1996

[54] TONER COMPOSITIONS WITH NEGATIVE CHARGE ENHANCING ADDITIVES

[75] Inventor: Beng S. Ong, Mississauga, Canada

[73] Assignee: Xerox Corporation, Stamford, Conn.

[21] Appl. No.: 523,576

[22] Filed: Sep. 5, 1995

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 5,223,368 | 6/1993 | Ciccarelli et al. | 430/110 |
| 5,275,900 | 1/1994 | Ong et al. | 430/110 |
| 5,300,387 | 4/1994 | Ong | 430/110 |
| 5,302,481 | 4/1994 | Ong | 430/106 |
| 5,346,793 | 9/1994 | Bertrand et al. | 430/110 |
| 5,346,795 | 9/1994 | Pickering et al. | 430/110 |
| 5,409,794 | 4/1995 | Ong | 430/110 |

*Primary Examiner*—Roland Martin
*Attorney, Agent, or Firm*—E. O. Palazzo

[57] ABSTRACT

A toner composition comprised of toner resins, colorants, optional surface additives, and a charge enhancing additive obtained from the reaction of an aluminum ion-containing compound with a molar equivalent of an aromatic carboxylic acid, and an excess of an N-alkyl or N-aryl-substituted bis(hydroxyalkyl)amine in an aqueous medium at a temperature ranging from about 25° C. to about 100° C.

24 Claims, No Drawings

TONER COMPOSITIONS WITH NEGATIVE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of toner resins, color pigment particles or dye molecules, and aluminum charge enhancing additives. Also, in embodiments the present invention is directed to toners with aluminum charge enhancing additives comprised of an aluminum ion coordinating to two different organic ligands, one derived from an aromatic carboxylic acid, and the other from N-alkyl or N-aryl-substituted bis(hydroxyalkyl)amine. These charge enhancing additives in embodiments generally possess acceptable polymer compatibility, which promotes their dispersibility in toner resins, thereby enabling, for example, stable triboelectric characteristics. The aforementioned charge additives in embodiments of the present invention enable, for example, toners with rapid triboelectric charging characteristics, extended developer life, stable triboelectrical properties irrespective of changes in environmental conditions, and high image print quality with substantially no background development. The aforementioned toner compositions usually contain a colorant component comprised of, for example, carbon black, magnetites, or mixtures thereof, color pigments or dyes with cyan, magenta, yellow, blue, green, red, or brown color, or mixtures thereof thereby providing for the development and generation of black and/or colored images. The toner and developer compositions of the present invention can be selected for electrophotographic, especially xerographic imaging, and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in. the '064 patent toner compositions with chromium, cobalt, and nickel complexes of salicylic acid as negative charge enhancing additives. In U.S. Pat. No. 4,845,003, there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A rapid rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle.

Toner compositions with other negative charge enhancing additives include, for example, U.S. Pat. Nos. 5,300,387 and 5,302,481, the disclosures of which are totally incorporated herein by reference. The '387 patent discloses toner compositions comprised of a toner resin, a colorant, optional surface additives and a metal complex charge additive derived from the reaction of a dicarboxylic acid and a hydroxybenzoic acid with a metal ion. Structurally, these charge enhancing additives are anionic metal complexes containing an anion comprised of a central metal ion, such as aluminum, gallium, zinc, cobalt ion and the like, bonded to two different bidentate ligands derived from an aromatic dicarboxylic acid and a hydroxybenzoic acid, and a countercation of proton, ammonium ion, alkaline metal cation or the like. Similarly, the '481 patent describes toner compositions with aluminum charge additives with mixed ligands derived from hydroxyphenol and hydroxybenzoic acid. While these charge additives are effective in imparting negative charge to toners, their rates of charging are generaaly not as rapid, their preparative processes are generally not as straightforward or simple as the preparation of the charge additives of the present invention. Another advantage of the charge additives of the present invention is that they can be obtained from economical precursors. There are also disclosed in U.S. Pat. No. 5,409,794, the disclosure of which is totally incorporated herein by reference, toner compositions containing negative charge additives derived from the reaction of a metal, a metal carbonyl, a metal salt, or a metal oxide with a β-diketone, a β-keto ester, or a malonic ester in an aqueous or organic medium. These charge additives render toner compositions negative in triboelectric charging, however, their charging rates are generally slower than those of the charge additives of the present invention.

Developer compositions with charge enhancing additives, which impart a positive charge to toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing certain resin compatible quaternary ammonium compounds; U.S. Pat. No. 4,338,390, the disclosure of which is totally incorporated herein by reference, illustrates developer compositions containing as charge enhancing additives organic sulfate and sulfonates, which additives can impart a positive charge to the toner composition; and U.S. Pat. No. 4,298,672, the disclosure of which is totally incorporated herein by reference, illustrates positively charged toner compositions with resins and pigment particles, and as charge enhancing additives alkyl pyridinium compounds.

Although many charge enhancing additives are known, there continues to be a need for charge enhancing additives which when incorporated in toners, provide toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics.

Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of preferably from between about −10 to about −40 microcoulombs per gram, and triboelectric charging rates of preferably less than 120 seconds as measured by standard charge spectrograph methods when the toners are frictionally charged against suitable carrier particles via conventional roll milling techniques. The concentrations of the charge additives that can be incorporated into the toner compositions generally range from about 0.05 weight percent to about 5 weight percent, depending on whether the charge additive is utilized as a surface additive or as a dispersion in the bulk of the toner. The effective loadings of toner in the developer, that is toner and carrier particles, are, for example, from about 0.5 to about 10 weight percent, preferably from about 1 to about 5 weight percent.

Illustrated in copending applications U.S. Ser. No. 523,577 is a negatively charged toner composition comprised of toner resins, colorants, optional surface additives, and a metal charge enhancing additive obtained from the reaction of a metal ion with a molar equivalent of an ortho-hydroxyphenol and two molar equivalents of an aromatic carboxylic acid in an aqueous medium in the presence of a base; and U.S. Ser. No. 523,573 is a negatively charged toner composition comprised of a polymer resin or polymer resins, colorants comprised of pigment particles and/or dyes, optional surface additives, and a boron charge enhancing additive obtained from the reaction of an alkylboric acid or an arylboric acid and an N-alkyl- or N-aryl-substituted bis(hydroxyalkyl)amine, or a zinc charge enhancing additive obtained from the reaction of an aromatic carboxylic acid and an N-alkyl-or N-aryl-substituted bis(hydroxyalkyl)amine with a zinc ion-containing compound in aqueous medium.

SUMMARY OF THE INVENTION

Examples of objects of the present invention include:

It is an object of the present invention to provide toner and developer compositions with negative charge enhancing additives.

In another object of the present invention there are provided negatively charged toner compositions useful for the development of electrostatic latent images including color images.

A further object of the present invention is to provide toner and developer compositions utilizing economical negative charge enhancing additives, and which additives in embodiments are comprised of anionic aluminum complexes of ortho-hydroxyphenols and aromatic carboxylic acids.

In yet a further object of the present invention there may be provided, it is believed, humidity insensitive from about, for example, 20 to 90 percent relative humidity at temperatures of from 60° to 85° F. as determined in a relative humidity testing chamber, negatively charged toner compositions with desirable triboelectric charging rates of less than 120 seconds, and preferably less than 60 seconds, such as 15 to about 45, as determined by the charge spectrograph method, and acceptable triboelectric charging levels of from about −10 to about −40 microcoulombs per gram.

Another object of the present invention resides in the preparation of negative toners which will enable the development of images in electrophotographic imaging apparatuses, which images have substantially no background development thereon, are substantially smudge proof or smudge resistant, and therefore are of excellent resolution; and further, such toner compositions can be selected for high speed electrophotographic apparatuses, that is for example those exceeding 50 copies per minute, and more specifically, those with speed of from about 65 to about 120 copies per minute in embodiments.

These and other objects of the present invention may be accomplished in embodiments thereof by providing toner compositions comprised of a polymer or polymer resins, colorants comprised of pigment particles or dye molecules, and certain aluminum charge enhancing additives which are comprised of an aluminum ion coordinating to two different organic ligands derived from an aromatic carboxylic acid and N-substituted bis(hydroxyalkyl)amine. More specifically, the present invention in embodiments is directed to toner compositions comprised of resins, color pigment, or dyes, and an aluminum charge enhancing additive which may be illustrated by the following formulas (I) and (II):

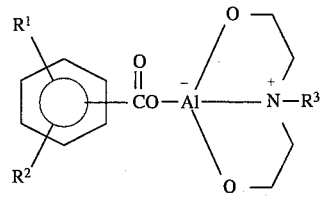

(I)

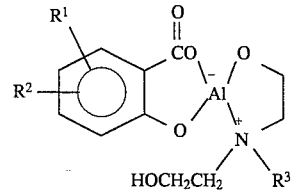

(IIa)

or

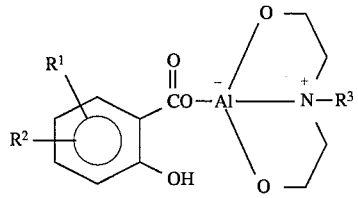

(IIb)

wherein $R^1$ and $R^2$ are independently selected from the group consisting of hydrogen, hydroxy, alkyl, alkoxy, aryl, and aryloxy, halide such as fluoride, iodide, chloride or bromide, cyano and nitro; and $R^3$ is an alkyl or aryl group. Examples of alkyl and alkoxy include those substituents with from 1 to about 20 carbon atoms, such as methyl, methoxy, ethyl, ethoxy, propyl, propoxy, butyl, butoxy, tert-butyl, tert-butoxy, pentyl, pentoxy, heptyl, heptoxy, octyl, octyoxy, nonyl, nonoxy, heptyl, heptoxy, stearyl, and the like, with tert-butyl ($^t$Bu) and butoxy groups being in embodiments the preferred alkyl and alkoxy groups, respectively. Examples of aryl and aryloxy groups include those with from 6 to about 30 carbon atoms such as, for example, phenyl, phenoxy, xylyl, xylyloxy, naphthyl, naphthoxy, and the like, with preferred aryl and aryloxy being in embodiments, respectively, xylyl and phenoxy groups.

In embodiments, the present invention is directed to a toner composition comprised of a polymer resin, polymer resins, especially thermoplastic resin particles, pigments and/or dyes, optional surface additives, and an aluminum charge enhancing additive derived from the reaction of an aluminum ion with an aromatic carboxylic acid and an N-substituted bis(hydroxyalkyl)amine; and a toner composition comprised of a polymer or polymer resins, pigments and/or dyes, optional surface additives, and an aluminum charge enhancing additive comprising a central aluminum ion coordinating to two different ligands deriving from an aromatic carboxylic acid and an N-substituted bis(hydroxyalkyl)amine. Also, embodiments of the present invention include a toner composition comprised of toner resins, colorants, and preferably pigments, optional surface additives, and a charge enhancing additive obtained from the reaction of an aluminum ion-containing compound with a molar equivalent of an aromatic carboxylic acid, and an excess of an N-alkyl or N-aryl-substituted bis(hydroxyalkyl)amine in an aqueous medium at a temperature ranging from about 25° C. to about 100° C., and wherein $R^1$ and $R^2$ alkoxy contain from 1 to about 10 carbon atoms, aryl contains from 6 to about 30 carbon atoms, aryloxy contains from 6 to about 30 carbon atoms, and $R^3$ is alkyl containing from 1 to about 20 carbon atoms or aryl containing from 6 to about 30 carbon atoms, wherein in embodiments the rate of charging of the toner is less than about 60 seconds as measured by a charge spectrograph method, the negative toner triboelectric charge in embodiments is from between about −8 to about −40 microcoulombs per gram, and which toners further contain a wax component which, for example, has a weight average molecular weight of from about 1,000 to about 7,000; and a process for the preparation of aluminum charge additives comprising treating a stirred suspension of an aromatic carboxylic acid in an aluminum ion solution containing one molar equivalent of aluminum ion with excess N-alkyl or an N-aryl-substituted bis(hydroxyalkyl)amine at a temperature of from about 25° C. to about 100° C. Moreover, in embodiments the present invention is directed to toners with charge enhancing additives with two different types of ligands derived from ortho-hydroxyphenol and carboxylic acid, wherein the orthohydroxyphenol enhances the additive admix properties and the carboxylic acid imparts negative charging characteristics to the charge additive.

The aforementioned charge additives can be incorporated into the toner, may be present on the toner surface, or may be present on toner surface additives such as colloidal silica particles. Advantages of rapid triboelectric charging characteristics of generally less than 120 seconds, preferably less than about 60 seconds, and more specifically, from about 15 to about 30 seconds, in embodiments as measured by the standard charge spectrograph methods when the toners are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles with a volume average diameter of from about 3 to about 20 microns.

The aluminum charge enhancing additives of the present invention are generally prepared in excellent yield by the treatment of a well-stirred suspension of an aromatic carboxylic acid in an aqueous medium containing a molar equivalent of an aluminum ion with two or more molar equivalents of a bis(hydroxyalkyl)amine at a temperature ranging from ambient to about 100° C. In general, the preferred aromatic carboxylic acids include hydroxy-substituted benzoic acids, while preferred bis(hydroxyalkyl)amines are N-alkyl or N-aryl bis(hydroxyethyl)amines.

The toner compositions of the present invention can be prepared by a number of known methods such as admixing and heating polymer resins such as styrene butadiene copolymers, colorants such as color pigment particles or dye compounds, and the aforementioned metal chelate charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 2 to about 20 microns, and preferably from about 3 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of the invention aluminum charge enhancing additives are represented by the following formulas and structures (III) through (XII), wherein Ph is phenyl, and $^t$Bu is tertiary butyl.

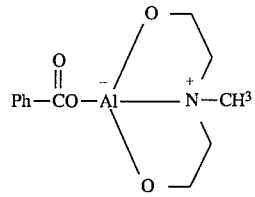

(III)

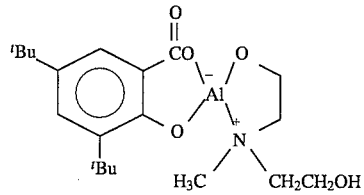

(IV)

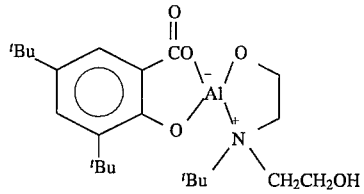

(V)

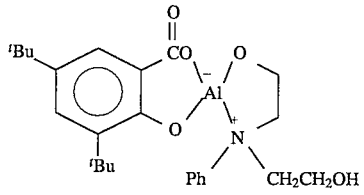

(VI)

-continued (VII)

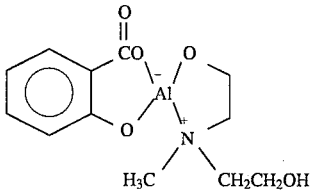

(VIII)

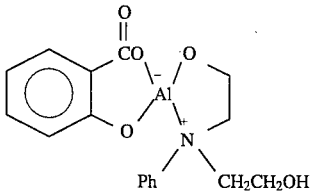

(IX)

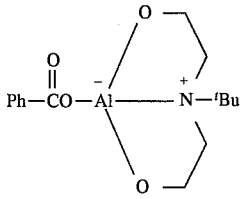

(X)

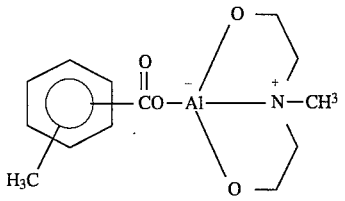

(XI)

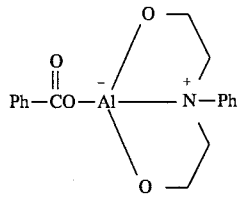

(XII)

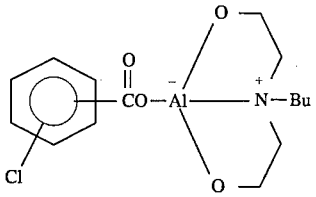

Illustrative examples of toner resins, toner particles, or toner polymers selected for the toner and developer compositions of the present invention include vinyl polymers such as styrene polymers, acrylonitrile polymers, vinyl ether polymers, acrylate and methacrylate polymers; styrene acrylates, styrene methacrylates, styrene butadienes; epoxy polymers; polyurethanes; polyamides and polyimides; polyesters; and the like. The polymer resins selected for the toner compositions of the present invention can include homopolymers or copolymers of two or more monomers. Furthermore, the above mentioned polymer resins may also be crosslinked depending on the desired toner properties. Illustrative vinyl monomer units in the vinyl polymer resins include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacols, cyclopentanediols, hydrobenzoins, bis(hydroxyphenyl)alkanes, dihydroxybiphenyls, substituted dihydroxybiphenyls, and the like.

As a toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Pat. No. 5,376,494 and U.S. Pat. No. 5,227,460, the disclosures of which are totally incorporated herein by reference, can be selected as toner resins. Other specific toner resins include styrene-methacrylate copolymers, and styrene-butadiene copolymers; PLIOLITES®, a styrene butadiene available from Goodyear Chemical; and suspension polymerized styrene-butadienes, reference U.S. Pat. No. 4,558,108, the disclosure of which is totally incorporated herein by reference. Generally, thus there can be selected as the toner resin particles known thermoplastic styrene methacrylates, styrene acrylates, styrene butadienes, and polyesters. Also, waxes with a molecular weight of from about 1,000 to about 10,000, such as polyethylene, polypropylene, and paraffin waxes, can be included in or on the toner compositions as fuser roll release agents.

The toner resin is present in a sufficient, but effective amount, for example from about 40 to about 98 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition comprised of resin, pigment or colorant, and charge additive; however, lesser or greater amounts of colorant may be selected in embodiments.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK™, they are present in the toner composition in an amount of from about 5 weight percent to about 60 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK™, in an amount of, for example, from about 5 to about 60, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL®, metal salts, metal salts of fatty acids, and metal oxides, inclusive of zinc stearate, aluminum oxides, cerium oxides, titanium oxides, and mixtures thereof, which additives are present in an amount of from about 0.1 percent by weight to about 5 percent by weight, and preferably in an amount of from about 0.25 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL® can be surface treated with the charge additives of the present invention illustrated herein in an amount of from about 1 to about 50 weight percent and preferably 10 weight percent to about 25 weight percent followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent. Also, in embodiments the waxes selected may possess a weight average molecular weight of from about 1,000 to about 20,000.

Included within the scope of the present invention are colored toner and developer compositions comprised of toner resins, the charge enhancing additives illustrated herein, optional surface additives, and as colorants, or pigments red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta colorants that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan colorants that may be used include copper phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow colorants that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent, and preferably from about 1 to about 5 percent by weight based on the total weight of the toner components of resin, pigment, and charge additive.

The toners of the present invention are usually jetted and classified subsequent to preparation to enable toner particles with a preferred volume average diameter of from about 2 to about 20 microns, and preferably from about 3 to about 12 microns. The triboelectric charging rates for the toners of the present invention are preferably less than about 120 seconds, that is for example from about 15 to about 120 seconds, and more specifically, less than 60 seconds, that is for example from about 30 to about 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

For the formulation of developer compositions, there are mixed with the toner particles carrier components, particularly those that are capable of triboelectrically assuming an opposite polarity to that of the toner composition. Accordingly, the carrier particles of the present invention are selected to be those which would render the toner particles negatively charged while acquiring a positive charge polarity themselves via frictional charging against the toner particles of the present invention. The opposite charge polarities of the carrier and toner particles of the developer composition thus ensure that the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos.

3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 25 microns to about 500 microns, and preferably from between about 40 and 150 microns in volume average diameter thereby permitting them, for example, to possess sufficient density and inertia to avoid adherence to the electrostatic images during the development process. The carrier component can be mixed with the toner composition in various suitable combinations, such as about 0.5 to 5 parts of toner to about 100 parts by weight of carrier.

The toner composition of the present invention can be prepared by a number of known methods including extrusion melt blending the toner resins, colorants, and the charge enhancing additive, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein, or are known.

The toner and developer compositions of the present invention may be selected for use in electrostatographic imaging and printing apparatuses containing therein photoreceptors, or photoconductive imaging members, reference U.S. Pat. No. 4,265,900, the disclosure of which is totally incorporated herein by reference.

The following Examples are being supplied to further illustrate various embodiments of the present invention, it being noted that these Examples are intended to illustrate and not limit the scope of the present invention. Comparative Examples are also presented.

EXAMPLE I

The aluminum charge enhancing additive (IV) was prepared according to the following procedure.

A mixture of 16.70 grams of aluminum sulfate octadecahydrate and 12.5 grams of 3,5-di-tert-butylsalicylic acid in 100 milliliters of water was mechanically stirred and heated to 80° C. to 90° C. in a 1 liter round-bottomed flask fitted with a water condenser. To this reaction mixture was added dropwise a solution of 14.9 grams of N-methyl bis(hydroxyethyl)amine in 50 milliliters of water over a period of 30 minutes. Subsequently, the reaction mixture was further stirred at the same temperature for another 2 hours, and then cooled down to about 45° C. and filtered. The grayish aluminum complex was washed several times with water, and was dried in vacuo at 65° C. for 36 hours. The yield was 87 percent.

EXAMPLE II

The aluminum charge enhancing additive (V) was prepared in accordance with the procedure of Example I except that N-t-butyl bis(hydroxyethyl)amine was utilized in place of N-methyl bis(hydroxyethyl)amine. The yield was 91 percent.

EXAMPLE III

The aluminum charge enhancing additive (IX) was prepared in accordance with the procedure of Example I except that benzoic acid was utilized in place of 3,5-di-tert-butylsalicylic acid. The yield was 84 percent.

EXAMPLE IV

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference, and 6.0 weight percent of REGAL 330® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface coated with 0.25 weight percent of the aluminum charge enhancing additive (IV) as obtained in Example I by a conventional dry blending method for 30 to 60 seconds.

The above treated toner was equilibrated at room temperature under a 50 percent relative humidity condition for 24 hours. A developer was then prepared by blending 2.0 weight percent of the surface treated toner with 98.0 weight percent of a carrier containing a nickel zinc ferrite core and 0.9 weight percent of a polymer composite coating comprised of 80 weight percent of a methyl terpolymer (styrene, n-butyl methacrylate, and triethoxysilane, and which terpolymer is commercially available) and 20 weight percent of VULCAN XC72™ carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −19.6 microcoulombs per gram by the standard blow-off technique in a Faraday Cage apparatus. To measure the rate of triboelectric charging of toner, 1.0 weight percent of the above prepared uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging was less than 30 seconds, and more specifically, 15 seconds in embodiments.

COMPARATIVE EXAMPLE (A)

A comparative black toner with a commercial charge enhancing additive, BONTRON E-88™ obtained from Orient Chemicals, which is believed to be an anionic complex of an anion of two 3,5-di-tert-butylsalicylic acid ligands bonded to a central aluminum atom, and a countercation of proton or alkaline metal ion, was prepared by blending the untreated toner (no charge additive) of Example IV with 0.25 weight percent of BONTRON E-88™, and a developer was then prepared from this toner in accordance with the procedure of Example IV. The toner exhibited a triboelectric charge of −40.4 microcoulombs per gram, and its rate of charging was measured to be about 5 minutes.

COMPARATIVE EXAMPLE (B)

Another comparative black toner was prepared by blending the untreated toner (no charge additive) of Example IV with 0.25 weight percent of zinc(II) acetylacetonate of U.S. Pat. No. 5,409,794, and a developer was then prepared accordingly. The toner exhibited a triboelectric charge of −11.6 microcoulombs per gram, and its rate of charging was about 120 seconds.

EXAMPLE V

A black toner was prepared in accordance with the procedure of Example I using 0.20 weight percent of the aluminum charge enhancing additive (V) of Example II. A developer was then prepared with this toner in the same manner as in Example I. The toner exhibited a triboelectric charge of −18.3 microcoulombs per gram, and a rate of charging of about 45 seconds.

EXAMPLE VI

A black toner with 0.30 weight percent of aluminum complex (IX) as a surface charge enhancing additive was prepared in accordance with the procedure of Example I. A developer was then prepared with this toner accordingly. The toner displayed a triboelectric charge of −21.2 microcoulombs per gram, and its rate of charging was measured to be about 30 seconds.

COMPARATIVE EXAMPLE (C)

A comparative black toner was prepared by blending the untreated toner of Example IV with 0.30 weight percent of copper (II) acetylacetonate of U.S. Pat. No. 5,409,794, and a developer was then prepared from this toner in accordance with the above processes. The toner exhibited a triboelectric charge of −22.3 microcoulombs per gram, and its rate of charging was about 2 minutes.

EXAMPLE VII

A blue toner comprised of 94.0 weight percent of SPAR II™ polyester resin, 3.0 weight percent of PV FAST BLUE™ pigment, and 3.0 weight percent of the aluminum charge enhancing additive (IV) of Example I was prepared by melt blending these three components, followed by micronizing and classifying in accordance with the procedure of Example IV. The resulting toner had a volume average particle diameter of 9.7 microns, and a particle size distribution of 1.29. A developer was prepared with this toner using 2.0 weight percent of toner and a carrier containing a steel core, and 0.8 weight percent of a polymer composite coating comprised of 80 weight percent of polymethyl methacrylate and 20 weight percent of VULCAN XC72™ carbon black. The toner displayed a triboelectric charge of −19.8 microcoulombs per gram, and its rate of charging was measured to be about 45 seconds.

The toner was then surface coated with 0.5 weight percent of AEROSIL R972® by a conventional dry blending method, and a developer was prepared with this toner and the above carrier particles as before. The triboelectric charge of this toner was measured to be −23.9 microcoulombs per gram, and its rate of charging was 30 seconds.

COMPARATIVE EXAMPLE (D)

A comparative blue toner and developer composition with zinc(II) 3-phenyl-2,4-pentanedionate of U.S. Pat. No. 5,409,794 was prepared in accordance with the procedure of Example VII except that zinc(II) 3-phenyl-2,4-pentanedionate was utilized in place of the aluminum additive (:IV). The toner displayed a triboelectric charge of −9.3 microcoulombs per gram, and its rate of charging was about 3 minutes.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of toner resins, colorants, optional surface additives, and a charge enhancing additive obtained from the reaction of an aluminum ion-containing compound with a molar equivalent of an aromatic carboxylic acid, and an excess of an N-alkyl or N-aryl-substituted bis(hydroxyalkyl)amine in an aqueous medium at a temperature ranging from about 25° C. to about 100° C.

2. A toner composition comprised of thermoplastic resin, pigment, optional surface additives, and a charge enhancing additive of the formulas (I); (IIa); or (IIb)

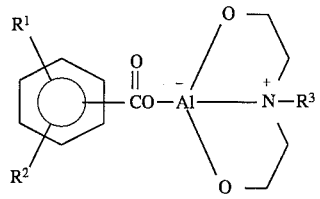

(I)

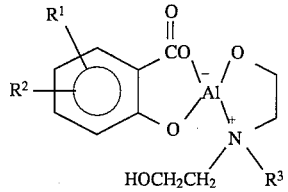

(IIa)

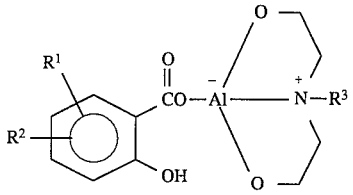

(IIb)

wherein $R^1$ and $R^2$ are independently selected from the group consisting of hydrogen, alkyl, alkoxy, aryl, aryloxy, fluoride, chloride, bromide, iodide, cyano and nitro; and $R^3$ is alkyl or aryl.

3. A toner composition in accordance with claim 2 wherein $R^1$ and $R^2$ are alkyl containing from 1 to about 10 carbon atoms, and $R^3$ is alkyl with from 1 to about 20 carbon atoms.

4. A toner composition in accordance with claim 2 wherein $R^1$ and $R^2$ are hydrogen, or alkyl containing from 1 to about 10 carbon atoms, and $R^3$ is aryl group containing from 6 to about 30 carbon atoms.

5. A toner composition in accordance with claim 2 wherein $R^1$ and $R^2$ are alkoxy containing from 1 to about 10 carbon atoms, aryl contains from 6 to about 30 carbon atoms, aryloxy contains from 6 to about 30 carbon atoms, and $R^3$ is alkyl containing from 1 to about 20 carbon atoms, or aryl containing from 6 to about 30 carbon atoms.

6. A toner composition in accordance with claim 2 wherein the $R^1$ and $R^2$ are alkyl with from 1 to about 10 carbon atoms.

7. A toner composition in accordance with claim 2 wherein $R^1$ and $R^2$ are alkoxy with 1 to about 10 carbon atoms.

8. A toner composition in accordance with claim 2 wherein the charge additive is an aluminum complex as represented by formulas (III), (IV), (V), (VI), (VII), (IX), (X), (XI) or (XII):

(III)

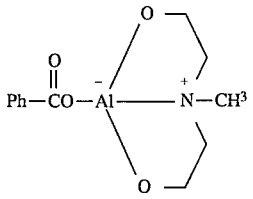

(IV)

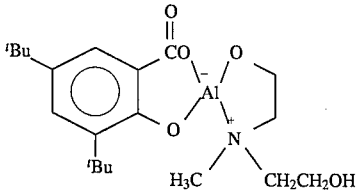

(V)

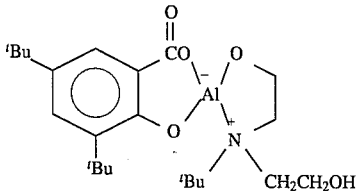

(VI)

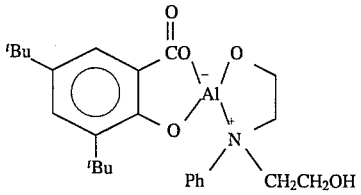

(VII)

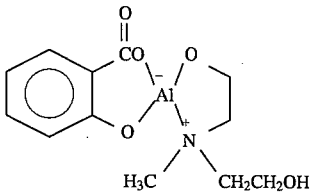

-continued (VIII)

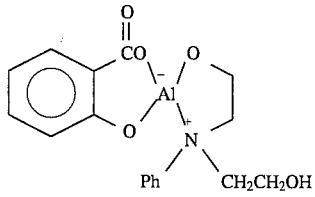

(IX)

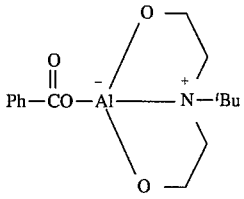

(X)

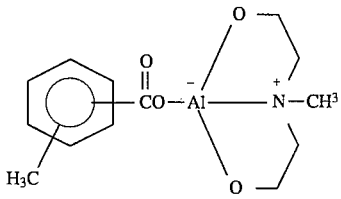

(XI)

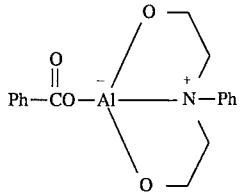

(XII)

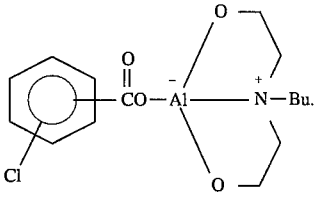

9. A toner composition in accordance with claim 2 wherein the charge additive is present in an amount of from about 0.05 to about 10 weight percent based on the total weight percent of thermoplastic resin, pigment, and charge additive.

10. A toner composition in accordance with claim 2 wherein the charge additive is incorporated into the toner, or present on the surface of the toner.

11. A toner composition in accordance with claim 10 wherein the charge additive is contained on colloidal silica particles.

12. A toner composition in accordance with claim 2 wherein the rate of charging of said toner is less than about 60 seconds as measured by a charge spectrograph method.

13. A toner composition in accordance with claim 2 with a negative triboelectric charge of from between about −8 to about −40 microcoulombs per gram.

14. A toner composition in accordance with claim 2 wherein the resin is comprised of styrene polymers.

15. A toner composition in accordance with claim 2 wherein the resin is selected from the group consisting of styrene acrylates, styrene methacrylates, styrene butadienes, and polyesters.

16. A toner composition in accordance with claim 2 further containing a wax component which has a weight average molecular weight of from about 1,000 to about 7,000.

17. A toner composition in accordance with claim 16 wherein the wax is selected from the group consisting of polyethylene and polypropylene, and wherein the wax is present in an amount of from about 1 to about 10 weight percent based on the total weight percent of resin, pigment, charge additive, and wax.

18. A toner composition in accordance with claim 2 containing surface additives selected from the group consisting of metal salts of a fatty acid, colloidal silicas, and mixtures thereof.

19. A toner composition in accordance with claim 2 wherein the pigment is selected from the group consisting of carbon black, magnetites, cyan, magenta, yellow, red, blue, green, brown, and mixtures thereof.

20. A developer composition comprised of the toner composition of claim 2 and carrier particles.

21. A developer composition in accordance with claim 20 wherein the carrier particles are comprised of ferrites, steel, or an iron powder with a polymer coating, or mixtures of polymer coatings thereover.

22. A developer composition in accordance with claim 21 wherein the coating is selected from the group consisting of a methyl terpolymer of styrene, butylmethacrylate, and triethoxysilane, a polyvinylidine fluoride, a polymethyl methacrylate, and a mixture of two polymers not in close proximity in the triboelectric series.

23. A toner in accordance with claim 2 wherein the pigment is present in an amount of from about 2 to about 10 weight percent based on the total weight percent of resin, pigment, and charge additive.

24. A toner in accordance with claim 2 wherein alkyl and alkoxy are selected from the group consisting of methyl, methoxy, ethyl, ethoxy, propyl, propoxy, butyl, butoxy, tert-butyl, tert-butoxy, pentyl, pentoxy, heptyl, heptoxy, octyl, octyoxy, nonyl, nonoxy, heptyl, heptoxy, and stearyl; and aryl and aryloxy are selected from the group consisting of phenyl, phenoxy, xylyl, xylyloxy, naphthyl, and naphthoxy.

* * * * *